US005277001A

United States Patent [19]

Bryant

[11] Patent Number: 5,277,001

[45] Date of Patent: Jan. 11, 1994

[54] MULTIPLE CONFIGURATION GRANDSTAND SEATING SYSTEM

[75] Inventor: James F. Bryant, Victorville, Calif.

[73] Assignee: Hussey Seating Company, North Berwick, Me.

[21] Appl. No.: 753,746

[22] Filed: Sep. 3, 1991

[51] Int. Cl.[5] ..... A47C 1/12; E04H 3/12

[52] U.S. Cl. ..... 52/10; 52/9; 52/8

[58] Field of Search ..... 52/6, 7, 8, 9, 10

[56] References Cited

U.S. PATENT DOCUMENTS

| | | | |
|---|---|---|---|
| 3,335,533 | 8/1967 | Bahr | 52/10 |
| 3,488,898 | 1/1970 | Scaggs | 52/10 |
| 3,608,251 | 9/1971 | Scaggs | 52/9 |
| 3,667,171 | 6/1972 | McClelland et al. | 52/9 |
| 4,063,392 | 12/1977 | Van Ryn et al. | 52/9 |
| 4,285,172 | 8/1981 | Quigley | 52/10 |
| 4,934,113 | 6/1990 | Hall et al. | 52/7 |

*Primary Examiner*—Carl D. Friedman
*Assistant Examiner*—Robert Canfield
*Attorney, Agent, or Firm*—Pandiscio & Pandiscio

[57] ABSTRACT

A telescopic grandstand is provided including a central support structure and two sets of interconnected telescopic grandstand seating tiers. One set of tiers is located adjacent one side of the support for telescopic movement between a closed position adjacent the vertical upright portion of the support and an open use position wherein the tiers of the set form a stepped configuration which extends outwardly from the adjacent side of the support and downwardly from the top of the vertical portion of the support. The second set of telescoping seating tiers is similarly located adjacent the other side of the vertical portion of the support. The entire unit is movable in directions normal to the sides of the vertical portion of the support, and means are provided for rotating the unit about a vertical axis. A method for using the grandstand also is provided such that the seating configuration of the open central area of an arena or the like may be readily, easily, inexpensively and safely converted among various desired configurations.

10 Claims, 4 Drawing Sheets

MULTIPLE CONFIGURATION GRANDSTAND SEATING SYSTEM

BACKGROUND

1. Field of Invention

The present invention relates generally to grandstand seating systems. More particularly, the invention relates to a grandstand seating system suitable for use with exhibition areas of different sizes and shapes.

2. Summary of the Prior Art

The majority of the grandstand seating configuration of an arena-like facility is substantially fixed. Typically, such seating is arranged in tiered, permanent rows built on one or more upwardly sloping reinforced concrete levels surrounding a central open area. The central open area is usually quite large. For example, it is common for the open central area of an arena to be large enough to accommodate a three ring circus or a political convention or a trade show. It will be understood, however, that when the facility is used for the presentation of a basketball game; an ice hockey game; an arena football, lacrosse, or soccer game; an ice show; or any other similar exhibition intended to draw numerous spectators, the floor space utilized by the playing or exhibition surface may be substantially smaller than the open central area of the arena. In order to maximize the number of possible spectators (and thus the revenue derivable from the event), seating between the permanent tiered seats and the exhibition floor must be provided. Heretofore, this has been accomplished in numerous ways.

The simplest of these configurations has been the provision of rows of seats directly on the floor of the central area surrounding the exhibition area. This solution is easily implemented, but is satisfactory only in those cases wherein the exhibition area is built up above the floor of the central area, as is often done for musical concerts. When the exhibition surface is formed on the floor of the central area, only those in the first few rows of seats surrounding the exhibition area will be able to see the exhibition easily. Obviously, such a situation is unacceptable for general application.

Another solution to this problem is the use of temporary grandstands which are assembled and disassembled as necessary to provide grandstand seating between the permanent tiers of seats and the exhibition floor. The assembly and disassembly of temporary seating and its associated scaffolding to achieve tiered rows of spectator seating between the permanent seats and the exhibition floor is a time consuming, expensive and potentially dangerous task. Even if the scaffolding is partially preassembled, it is heavy and unwieldy. Therefore, there is not only a potential for accidents during the assembly/disassembly operation, but also the time required for the assembly/disassembly may be quite long and expensive. Additional expense arises from the need either to provide storage for the scaffolding and related seating (assuming it is owned by the arena), or to rent same (if it is not owned by the arena). Similarly, a minor error during assembly, such as the failure to attach or to fully tighten a bolt, can result in injury to numerous spectators if the temporary unit fails during the exhibition. Accordingly, while temporary seating is sometimes still used by some arenas, it is not preferred in the art.

Yet another attempted solution to the problem of providing seating between the permanent seats of an arena and an exhibition floor smaller than the open central area of the arena is the use of telescopic grandstand seating. Telescopic seating systems are well known in the art as shown for example by U.S. Pat. Nos. 4,041,655; 3,667,171; and 3,364,637. In this type of seating, each of the tiers of seats is mounted on a rectangular support frame including upright rear posts, horizontal seat and deck supports connecting the top ends of the upright rear posts, brace members extending between the upright posts and the horizontal seat and deck supports, and horizontal wheeled carriages connected to the lower ends of the respective posts and extending normally to the plane of the remainder of the substantially rectangular support frame. Each of the separate tiers moves independently on its associated carriages, but interlocks with the tiers above and below it when the unit is expanded into its open position. In the closed position, the various tiers nest together such that the deck/seat support/seat rows are located substantially one on top of the other to thereby create a closed unit having a width only slightly greater than the width of one tier. In the open position, on the other hand, the unit displays the common stepped configuration of a grandstand. The interlocking of the tiers generally facilitates the opening operation and prevents over-expansion of the unit. Similarly, numerous locking devices have been utilized to prevent unintended movement of the tiers toward the closed position while the unit is in use. Many installations of such seating units have minimized the extension of the closed unit into the open central area of the arena by providing recesses in the walls of the central area beneath the front rows of the permanent seats into which the telescoping grandstand seating may be closed. The advantages of these systems are numerous. They are easy to open and close. They are safe. They may be stored when not in use directly adjacent the area in which they are used with little or no loss in the usable central area of the arena.

A problem with the use of telescopic grandstand seating in the arena context remains, however. Telescopic grandstand seating of the type just described is customarily designed for use with an exhibition floor area of a particular size and shape. For example, the conversion of an open central area from a configuration suitable for a convention or trade show to a configuration suitable for a basketball game may involve locating a basketball playing surface (court) centrally on the floor of the open central area of the arena, and providing telescopic grandstand seating which extends from the permanent seating at a downward angle to a point adjacent the basketball playing surface. In that case, the respective telescopic seating units are simply opened from their closed configuration in the storage recesses in the walls of the central area. Individual seats thereafter are added to the seat supports if they are not integrally incorporated into the telescopic seating system itself. The units lock together tier to tier by means of internal mechanisms generally provided as part of the units. Similarly, the units are easy to attach together one unit to the next for added stability, if desired.

If one assumes the need to provide seating extending between the permanent seating of the arena and playing surfaces of two different sizes (such as an ice rink and a basketball court), however, the conversion of the arena amongst its various desired seating configurations becomes more complex. This is particularly true because the boards surrounding a hockey rink are a fairly permanent structure, and the required conversion time between a hockey game in the afternoon and a basketball game the same evening is on the order of two and one-half hours. A telescopic grandstand adapted to extend from the permanent seats to a point adjacent the ice will not reach a point adjacent the smaller dimensions of a basketball court. Similarly, a telescopic grandstand adapted to extend from the permanent seats to a point adjacent a basketball court cannot be fully opened to provide seating extending between the fixed seats and a point adjacent the edge of the ice. The pitch of the tiers of seats extending downward from the permanent seats is different in each case, and standard telescopic grandstand seating cannot solve both situations simultaneously. This circumstance is diagrammatically illustrated in FIG. 1 wherein a conventional telescopic grandstand located adjacent a hockey rink is shown in solid lines, and the typical location of a basketball or other smaller exhibition surface and the desired grandstand pitch for use therewith are shown in phantom.

Attempts have been made to adapt telescopic grandstand seating to solve this problem. One such proposal is to adjust the pitch of the telescopic seating from the shallow pitch used for a basketball game, for example, to the steeper pitch required for a larger playing surface, such as for a hockey game for example, by telescoping some of the tiers of the telescopic seating unit beneath the tiers directly above them (see, for example, U.S. Pat. No. 3,364,637). This so-called "double decking" approach can also be utilized to alter the configuration of a unit designed to extend to a point adjacent a smaller exhibition surface such that a preselected number of the lower tiers are all telescoped inwardly. In this configuration, the pitch of the seating changes and the lowermost row of useable seating might be located adjacent to the top of the hockey boards. In that case, temporary seating modules are placed inwardly of the boards to provide seating from the top of the boards down to a point adjacent the basketball court. It will be understood however that this so-called double decking introduces complexity in locking the various tiers together in the desired configuration. The few times that it has been tried commercially, it has proven to be undesirable.

Separate telescopic seating units could be constructed for each of the required seating configurations and substituted for each other as the situation warranted. Devices for moving telescopic seating units from place to place are well known in the art. This solution is impractical because the exchange of telescopic seating units one for another is both time consuming and expensive. Further, the necessity of providing storage outside the arena for the units not in place along the walls of the central area is cumbersome and expensive. Accordingly, this alternative also is not entirely satisfactory.

SUMMARY OF THE INVENTION

Accordingly, the object of the present invention is to provide a seating system for an arena or the like which is easily, safely and quickly convertable amongst configurations suitable for use with the most commonly utilized exhibition surfaces of the arena.

To accomplish this objective, the present invention provides a multiple configuration telescopic seating unit including two, oppositely facing sets of interlocked, telescoping seating tiers attached to a common central support structure. The support structure includes a pair of carriage members; an upright extending vertically from the central portion of each of the carriage members; and horizontal connecting means extending between the upper portions of the uprights.

In a preferred embodiment, the sets of telescopic seating tiers are of the conventional type wherein the horizontal deck and seat supports are supported independently on vertical rear posts which are mounted on carriages fitted with rollers so that they may be rolled outwardly or inwardly between set-up and stowed positions. The carriages are generally elongate members supporting the vertical posts adjacent their rear ends arranged to move side-by-side beneath the grandstand. The carriages supporting each of the various tiers also engage the carriages supporting the next higher tier in a manner which determines the maximum separation between the tiers and provides a means for releasably locking the grandstand in the open position. The pitch of the steps formed by the tiers in the open position depends primarily upon the relative heights chosen for the respective vertical column pairs supporting the various tiers -the greater the difference in height between adjacent pairs of vertical supports, the greater the pitch of the open grandstand. The spacing between the rows of seating is substantially standardized.

The carriage members of the support structure also are elongate, and arranged parallel and adjacent to the outermost tier support carriages of the two sets of telescoping tiers. They each include a central portion from which the associated upright extends vertically, and a first end portion adjacent one end and a second end portion adjacent the other end. The length of the end portions is approximately the same as the length of the carriages of the tier supports lying adjacent thereto. The support carriages engage the adjacent carriages of the uppermost tiers in a manner similar to the engagement of the respective tier support carriers to each other to prevent the movement of the respective tier sets away from the central support. The support carriages also ride on means such as casters so that the support structure may be easily moved in the directions of expansion of the sets of telescopic seating tiers therefrom, but not otherwise. These casters are releasably lockable separately from the casters of the tier supports to prevent movement of the support during the expansion of one, the other, or both of the tier sets relative to the support.

The support uprights are vertical members having a width approximately one-half of the width of the tiers of the attached telescoping grandstands, and a thickness approximately the same as the width of the support carriage members. The connecting members extend between the upper ends of the vertical members and may include a horizontal deck located between seats attached to seat supports mounted to the uprights adjacent to the deck and on opposite sides of the support structure. The uppermost tier of each set of tiers therefore forms the second from the top row of seating when it is opened. Since the unit can only move in two opposite directions on the roller means associated with the bases of the support structure and the various tiers, the present invention also contemplates a rotating turntable may be provided onto which the back-to-back telescopic grandstand can be rolled while in its closed configuration, rotated, and from which it can thereafter be rolled back to its original position.

BRIEF DESCRIPTION OF THE DRAWINGS

These and other features and advantages of the present invention will become apparent to those skilled in the art with reference to the following detailed description of a preferred embodiment of the invention set forth below with specific reference to the accompanying drawings in which.

DETAILED DESCRIPTION OF PREFERRED EMBODIMENT

Figure 1:
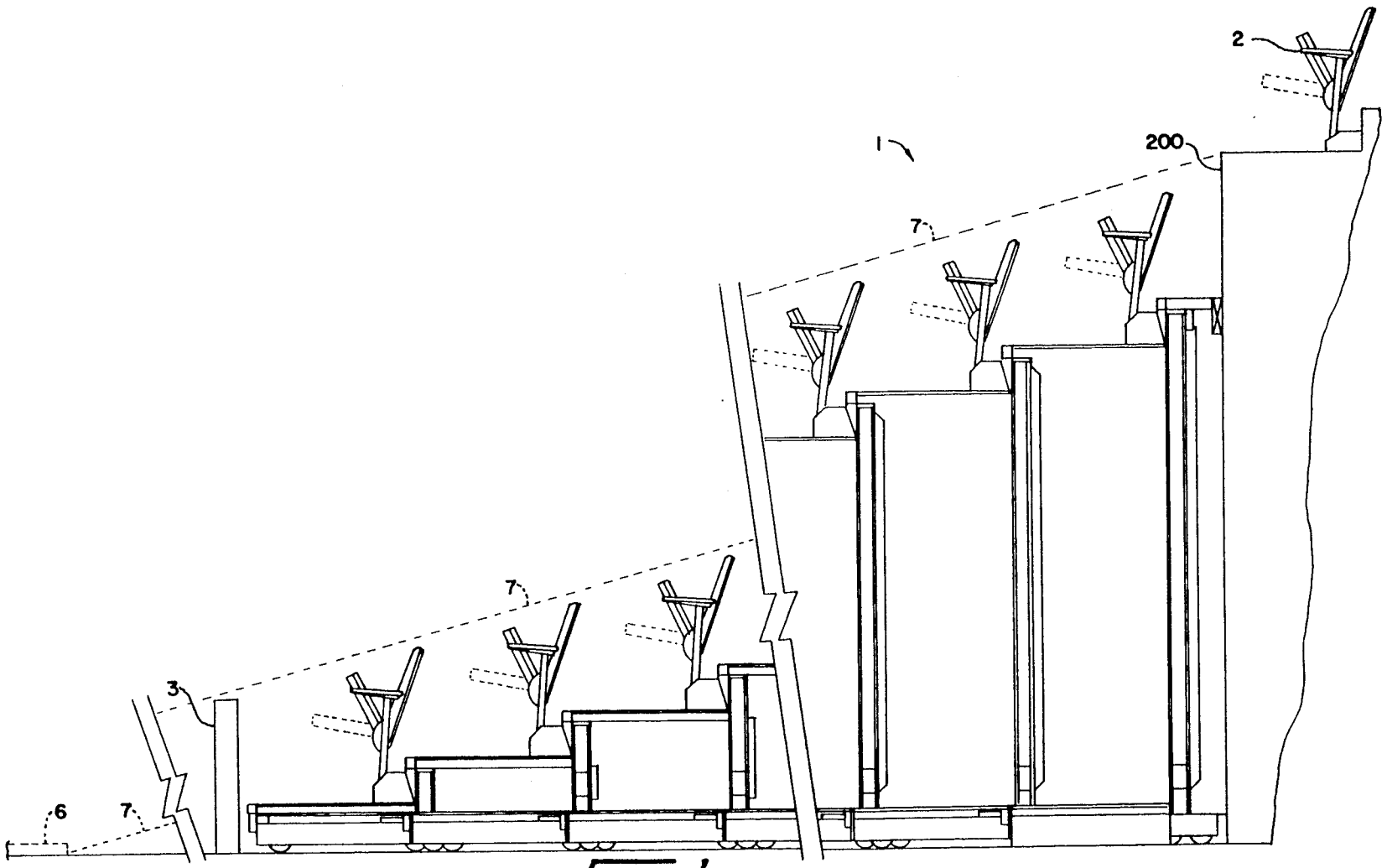
Fig. 1 PRIOR ART
FIG. 1 is a view in side elevation, partially broken away, of a telescoping grandstand in set up position between a slanted level of permanent tiered seating and a playing surface surrounded by a barrier in accordance with the prior art.

Referring now to the drawings, and particularly to FIG. 1, there is shown a telescoping grandstand, generally indicated at 1, in accordance with the teachings of the prior art in its open configuration. The telescopic grandstand extends outwardly and downwardly generally from the first row of permanent arena seating 2 to a point adjacent the boards surrounding a hockey rink or a similar barrier, generally indicated at 3. As alluded to above, this structure cannot easily and inexpensively be converted to provide seating for say a basketball game which utilizes a much smaller playing surface than a hockey rink. Such a smaller exhibition area 6 is shown in phantom in FIG. 1 along with the required pitch 7 of the grandstand to be used therewith.

Figure 2:
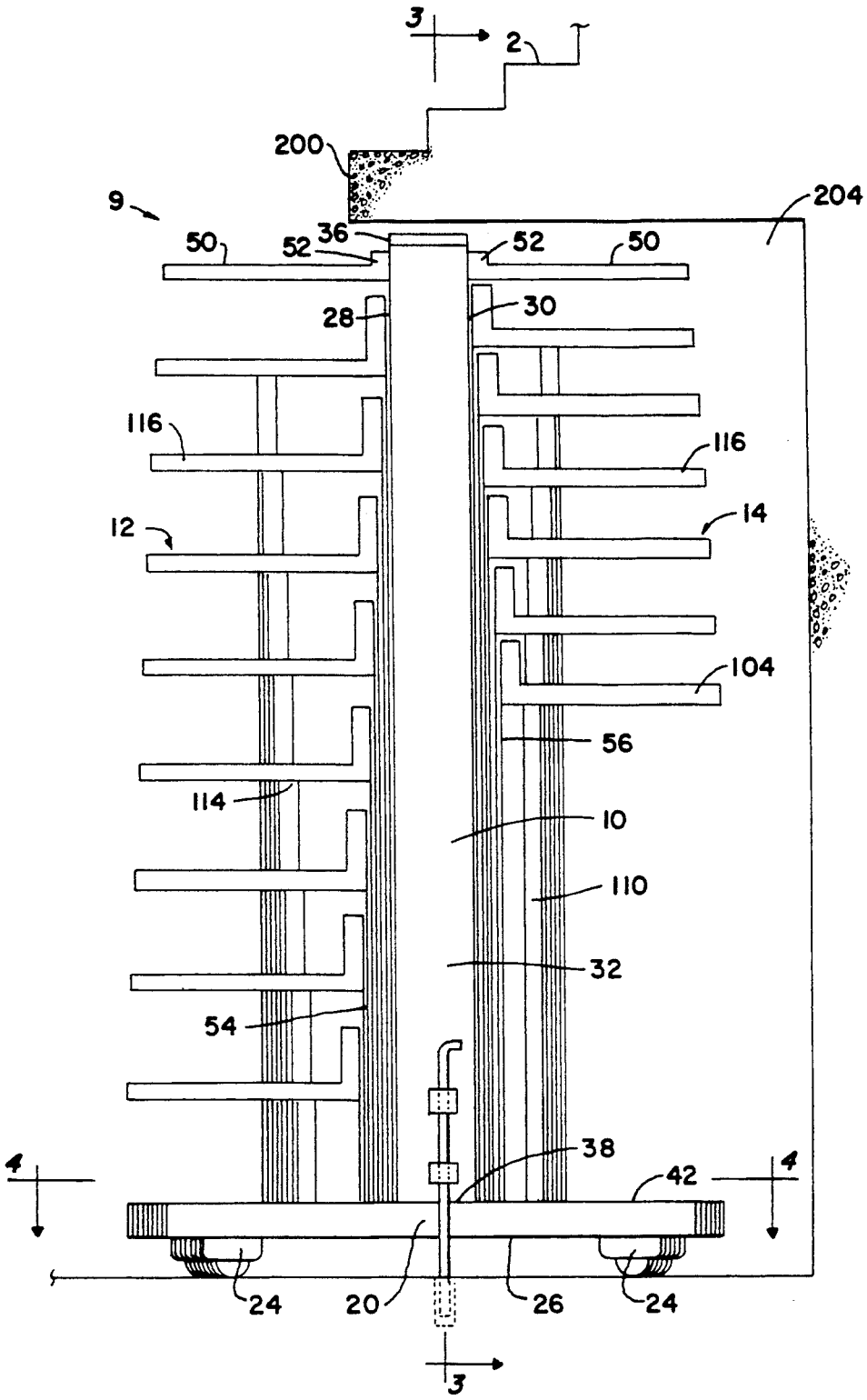
FIG. 2 is a diagrammatic view in side elevation of the multiple configuration telescopic grandstand of the present in its fully closed position and located in a wall recess.
Figure 3:
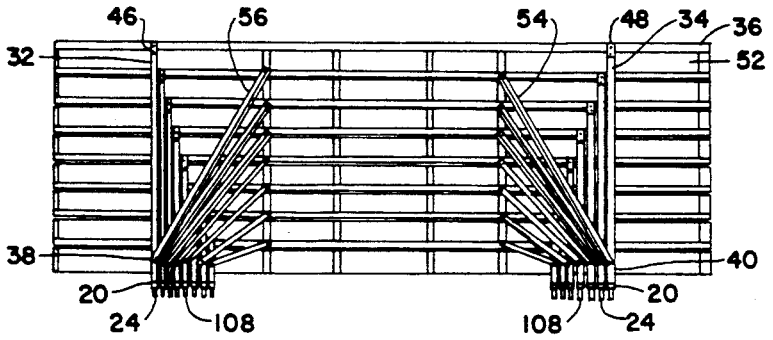
FIG. 3 is a sectional view of the multiple configuration telescopic grandstand of FIG. 2 taken along the line 3—3.
Figure 4:
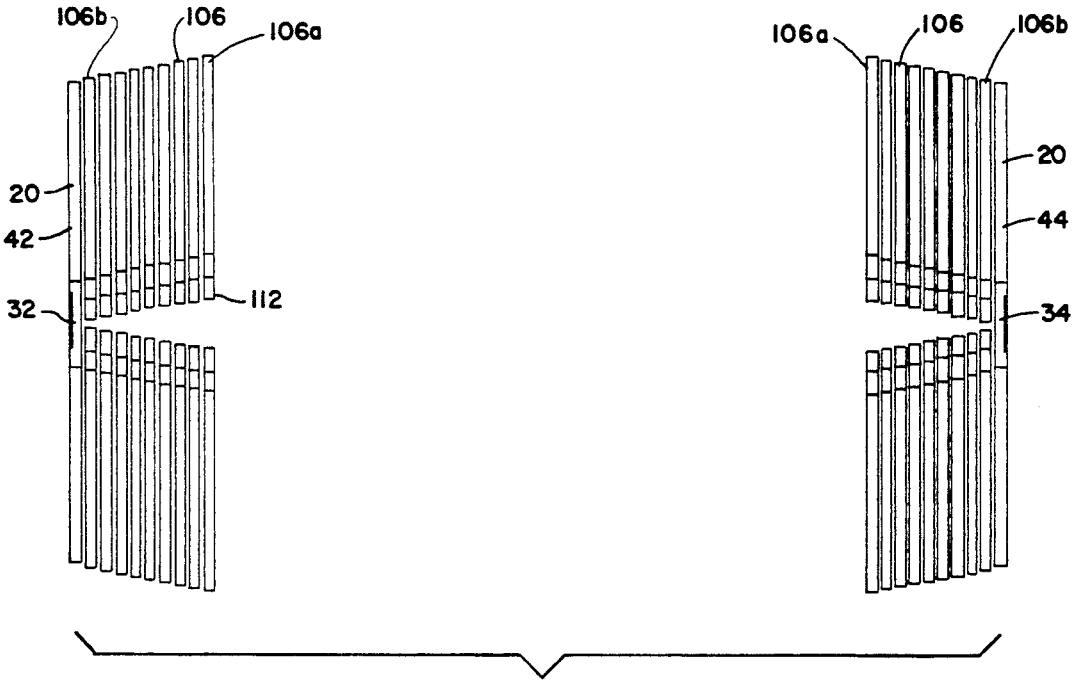
FIG. 4 is a sectional view, partially broken away, of the multiple configuration telescopic grandstand of FIG. 2 taken along the line 4—4; and, FIG. 5 is a diagrammatic perspective view of a pivoting dolly for use with a multiple configuration telescopic grandstand in accordance with the present invention.

The present invention resolves this problem by providing a multiple configuration telescopic grandstand system 9, as diagrammatically shown in FIGS. 2 through 4, which avoids the problems associated with the practice of "double decking", also discussed above. The multiple configuration telescopic grandstand of the present invention includes a central support structure 10 and two sets of telescoping tiers of grandstand seating 12 and 14 attached together to form a single composite structure.

In a preferred embodiment, the central support structure 10 (best seen in FIGS. 2–4) includes a pair of elongate, laterally spaced, floor engaging carriage portions 20, and a substantially vertical portion 22. Carriage portions 20 ride on rollers, such as casters 24, mounted adjacent the bottom surface 26 of the carriage portions 20 such that the carriage portions may be easily rolled forwardly and backwardly, but not to the side. Brake means (not shown) may be provided to selectively prevent and allow the movement of the carriage portions 20 on the casters 24. The vertical portion 22 defines first and second opposite sides 28 and 30 respectively. Included in this structure are support columns 32 and 34, and a deck 36. The support columns 32 and 34 are affixed at one of their ends, 38 or 40 respectively, centrally to the upper surfaces 42 and 44 of the carriage portions 20, and extend substantially vertically upwardly therefrom to top ends 46 and 48. Columns 32 and 34 may be formed as two or more side-by-side posts, however, it has been found to be preferable for overall strength and cost reasons to form these columns as single pieces. In the latter case, the columns are elongate members having a thickness comparable to that of the carriages, and a width approximately one-half of the desired separation between adjacent tiers of seating. The deck 36 extends between and is attached to the top ends 46 and 48 of the columns 32 and 34. Deck and seat supports 50 and 52 also extend between and are attached to the columns 32 and 34 on the first and second sides 28 and 30 of the vertical portion 22 respectively immediately below and adjacent to the deck 36. Grandstand seating members of any well known type such as that illustratively shown in FIG. 1 may be attached to seat supports 52 adjacent the deck 36 to form an uppermost row of seating on each side of the vertical portion of the support structure 19.

The support structure 10 may also be braced by members such as 54 and 56 (best seen in FIG. 3) which extend from the vertical columns 32 and 34 at an upward angle to the bottom of deck 36 between the columns 32 and 34. Obviously, other forms of bracing may be utilized, or the structure of the columns 32 and 34 may be chosen such that this bracing is not necessary. In either event, the invention contemplates that the support structure 10 will be substantially rigid, and that the extension of the carriage portions normally outwardly from the rectangular configuration formed by the columns and the deck will render the support structure extremely stable. Typically the length of this extension of the carriage portions 20 from the sides 28 and 30 of the vertical portion 22 will be equivalent to the length of the various carriage members 106 of the set of tiers 100 or 102 adjacent thereto (see FIG. 4). Any weakness in this regard is expected to be limited to lateral movement from side to side (i.e., sway). It is contemplated that any of numerous means well known in the art might be utilized to secure the upper ends of the columns to fixed vertical supports to avoid this problem. For example, the various units surrounding an exhibition area may be joined together and/or the deck 36 may be attached to an adjacent wall.

Two sets 12 and 14 of interconnected, telescoping tiers of grandstand seating also are provided—one located adjacent the first side 28 of the support 10, and the other located adjacent the other side 30 thereof. These sets of tiers of seating may take any of the well known forms present in the art (see, for example, FIG. 1). In the preferred embodiment illustrated in the drawings, each tier 104 of each set is substantially independent of the other tiers of the set with the exception of an interconnection which avoids over separation of the tiers which will be discussed below. Therefore, it will be seen that each tier includes a pair of carriage members 106 which ride forwardly and backwardly only on casters 108. The carriages for the various tiers are aligned in side-by-side relation, the carriages for the lowermost tier 106A located the furthest inwardly and the carriages of the highest tier 106B located the furthest outwardly. A post 110 is attached adjacent the rear end 112 of each of the carriage members 106 which extends substantially vertically upwardly to a top end 114. Deck and seat support members generally indicated at 115 and 116 extend between and are attached to the top ends 114 of the posts 110. As with the support structure, grandstand seating such as that shown in FIG. 1 may be attached to the seat supports 116 to complete the construction of each tier (if the same is not already present as part of the telescopic seating structure). It further will be understood that bench seating, separately attached seating, or the use of collapsible seating which will also fold for telescoping beneath the next above tier are all well known in the art. The use of any of these seating structures, or of some other structure, are all contemplated to be within the scope of the present invention in its broadest aspects.

The first set of tiers 12 of grandstand seating is located adjacent the first side 28 of the support structure 10 with the carriages 106B for the highest tier located between and adjacent to the carriage portions 20 of the support structure 10. Similarly, the second set of tiers 14 of grandstand seating is located adjacent the second side 30 of the support structure with the carriage members associated with the highest tier between and adjacent to the carriage portions of the support structure 10. In the closed or storage position, the posts, braces and carriages of the adjacent tiers are located in nested, substantially side-by side relation to each other and to the carriage, columns and braces of the support structure (see FIGS. 2 and 4). Therefore, it will be understood that in the closed position each set of tiers forms a very steeply pitched step configuration since the nesting of the posts and braces precludes the location of the lower tiers completely subadjacent to the next higher tier of the set. It also will be understood that the pitch of each of the two sets of tiers in the open, use position may be different. Further, one set of tiers may be made to terminate at a point substantially above the floor while the other tier may extend to a point adjacent the floor (see FIG. 2). The system thus may provide at least three separate and distinct seating configurations for the arena—one where the unit is entirely closed leaving substantially the entire central area of the arena free for use, one wherein the unit provides grandstand seating extending between permanent tiers of seats and a point adjacent a first playing surface, and one wherein the unit provides grandstand seating extending from the permanent seating tiers part or all of the way to a point adjacent a second playing surface smaller than the first playing surface. Of course, the unit also might be used in a configuration wherein both sets of telescopic grandstand seating are opened outwardly with respect to the support structure at the same time.

The following description of a method of use of the multiple configuration telescopic grandstand of the present invention will provide a more complete understanding of the apparatus provided by the present invention and its use. If one assumes an arena having a central open area surrounded by a wall 200 and rows 2 of permanent seating tiers extending at an angle upwardly and away from the central area, for example, the present invention allows the quick, easy, inexpensive and safe conversion of the arena seating configuration for numerous different events. Typically, units of the type described in detail above will be located in side-by-side relation to each other in a recesses provided in the walls surrounding the central area of the arena in their closed position such that little, if any of the unit projects into the central area of the arena. In this configuration, doors, canvas curtains or other means (not shown) may be provided to hide the closed units from the view of individuals using the arena either as spectators in the permanent seating or as participants in activities occurring on the floor of the central portion of the arena.

To convert the arena from the above configuration to seating appropriate for say a hockey game, the means hiding the units in the recesses are removed, and the seating tier facing the center of the central area of the arena is opened outwardly from the support structure. The opening operation may be either manual or assisted by a motor. In either event, the lowermost tier is moved outwardly from its nested position adjacent the support structure. After the lowermost tier has traveled a predetermined distance, its carriage members engage the carriage members of the next higher tier and move it along with the lowermost tier outwardly as the opening operation proceeds. This sequence is continued until all of the tiers of the first set have been moved outwardly from the support structure and the set forms the well known stepped tier pattern of a grandstand extending from the permanent seats at an angle downward and inward to a point adjacent the hockey playing surface (see, for example, FIG. 1).

Figure 5:
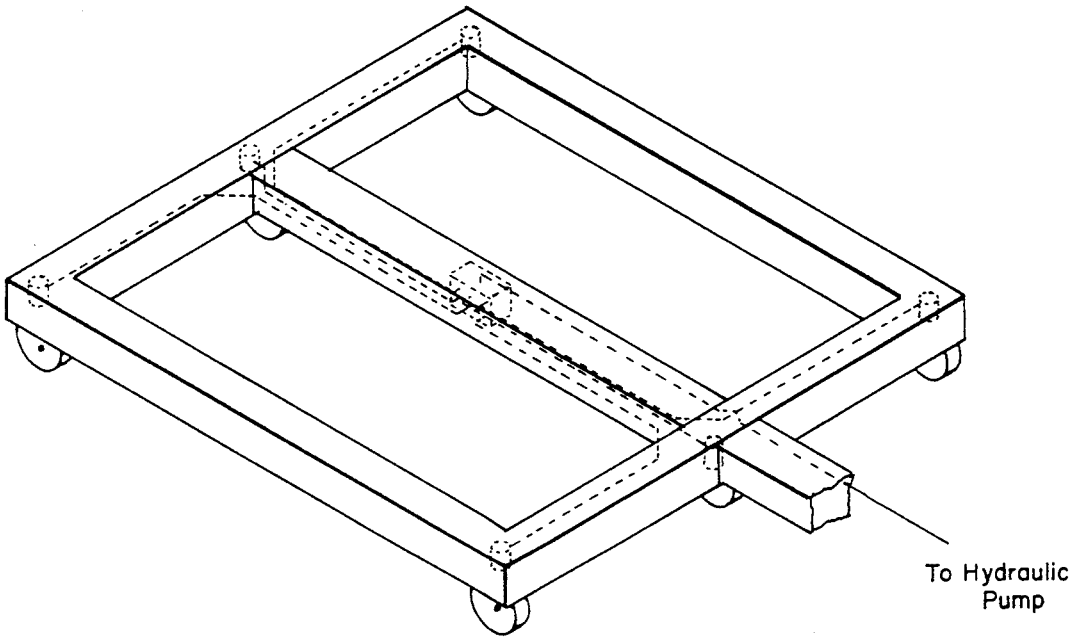

Assume now that the arena is to be use for a basketball game during the evening of the same day as the hockey game was played in the afternoon. The basketball floor 6, which is smaller than the hockey rink, is placed on the ice surface and seating is provided extending downwardly and inwardly from the permanent seating tiers to a point adjacent to the basketball floor. Sometimes the boards surrounding the ice rink are removed during such a conversion, and sometimes they are not. In this example it will be assumed that they are not. The first set 12 of telescoping tiers are closed to their storage position adjacent the support structure 10. Thereafter, the means holding the support structure in the recess are released. This may involve the release of brake means holding the casters of the carriages of the support structure immovable, the disengagement of means holding the decking of the support structure to the interior walls of the recess, the disengagement of pintles slidably attached to the vertical portions 22 from permanent locating holes in the floor of the central area of the arena (see, FIG. 2), and/or the release of some other support restraint. The entire unit is then moved out of the recess in the wall of the central portion of the arena and over (or onto) pivoting means such as the dolly illustratively shown in FIG. 5 whereupon it is rotated 180 degrees. The unit is then moved off of the pivoting means back into the wall recess from whence it came and secured in place by the brakes, securement means mentioned above, or some other convenient mechanism.

It, of course, will be understood that in the case of the dolly illustrated in the drawings, the dolly is placed on the floor of the central area adjacent to the unit. The unit is then rolled over the dolly, and hydraulically or pneumatically interconnected jacking devices associated with the swivel casters upon which the dolly rides lift the unit slightly off the floor. Thereafter, once the unit has been rotated 180 degrees about a vertical axis on the swivel casters of the dolly, the unit is lowered to the floor and rolled back into the recess from whence it came. Further, the dolly of the type illustrated could be permanently attached to the support structure 10 substantially centrally between the carriage portions 20. This alternative introduces substantial extra cost over the alternative of using the same dolly to rotate a number of seating units sequentially, and therefore, it is not preferred. Other pivoting means such as a portable turntable also may be used for unit rotation without departure from the invention in its broader aspects.

At this point, the first set 12 of tiers will be facing into the recess and the second set 14 of tiers will be facing the central portion of the arena. The second set 14 of telescoping tiers is then opened from its closed position to its open position in the same manner as the first set of tiers was opened previously. The design of the second set of tiers, however, is selected in this case such that in the open position the tiers of seating extend downward in inward from the permanent seating substantially to the top of the boards 3 surrounding the hockey rink (i.e., at a substantially different pitch 7 than the pitch of the first set of tiers). Finally, temporary seating is constructed which extends inwardly and downwardly from the top of the hockey boards to a point adjacent to the basketball floor. The latter temporary seating is much less cumbersome than temporary seating for the entire seating configuration. It is more easily and quickly assembled, less expensive, and safer as well.

It therefore will be seen that the apparatus provided by the present invention has allowed the arena to be converted among three separate seating configurations quickly, easily and safely. Of course, those skilled in the art will understand that even greater versatility may be achieved in the event that a workable system of the so-called double decking type discussed above is developed. In that event, the three basic configurations discussed herein—no seating in the central area and seating having two substantially different pitch angles—might be modifiable to accommodate five or more configurations in the same unit.

Various modifications, adaptations, abridgments, and obvious variations will occur to those skilled in the art in view of the foregoing detailed description of a preferred embodiment of this invention. For example, different sorts of turntables and/or unit moving and rotating devices might be used, and various differing usage contexts may suggest revisions to the application method described herein. For example, it might be desirable to provide a grandstand structure having seating on two sides for use in an "infield" surrounded by a racetrack, and to have the capability of also using the same grandstand structure adjacent to a wall of the same arena. The present invention in its broadest aspect encompasses this and similar modified usage contexts.

Accordingly, the foregoing specification is intended to be illustrative only, and in no way limiting of the invention. The invention is to be understood as limited only by the terms of the appended claims.

I therefore claim:

1. A multiple configuration telescopic grandstand comprising:

a support structure including a vertical portion having a top edge, a first side and a second side; and, two sets of interconnected, telescoping tiers of grandstand seating connected to said support structure such that one of said sets may be moved selectively between a closed storage position substantially adjacent to said first side of said vertical portion of said support structure and an open use position in which the seating tiers extend in stepped relation outwardly from said first side of said vertical portion of said support and downwardly from said top edge of said vertical portion, and such that the other of said sets may be moved selectively between a closed storage position adjacent the second side of said vertical portion of said support and an open use position in which the seating tiers of said second set extend in stepped relation outwardly from said second side of said vertical portion of said support and downwardly from said top edge of said vertical portion of said support.

2. The multiple configuration telescopic grandstand of claim wherein said:

support structure includes a pair of elongate, laterally spaced, floor-engaging carriage portions, said vertical portion includes a support column affixed centrally to each of said carriage portions and extending upwardly therefrom to a top end, deck means extending between and connected to said top ends of said columns, bracing means extending at an angle between said columns and said deck means, and a row of grandstand seating located on each of said sides of said vertical portion adjacent said deck means; and, wherein said sets of telescoping tiers respectively extend in the open use position outwardly and downwardly from said rows of grandstand seating attached to said first and second sides of said vertical portion of said support.

3. The multiple configuration telescopic grandstand of claim 1 wherein the pitch of the tiers of said first set in the open position is different from the pitch of the tiers of said second set in the open use position.

4. The multiple configuration telescopic grandstand of claim 1 wherein the tiers of said first set in their open position extend outwardly and downwardly to a point substantially adjacent the floor, and the tiers of said second set in their open use position extend outwardly and downwardly to a point substantially vertically spaced from the floor.

5. The multiple configuration telescopic grandstand of claim 2 wherein each of said sets of tiers comprises a plurality of separate support assemblies each including a pair of laterally spaced floor-engaging carriage means, a post affixed to each said carriage means and extending upwardly therefrom to a top end, deck and seat support means connecting said top ends of said posts, bracing means extending at an angle from said posts to said deck and seat support means, and grandstand seating means attached to said seat support means.

6. The multiple configuration telescopic grandstand of claim wherein the laterally spaced carriage means of the various support assemblies of the tiers of each said set are aligned side-by-side and interconnected with each other and with an adjacent portion of one of the carriage portions of said support structure such that as the lowermost tier is moved from its storage position toward its use position it will travel freely for a preselected distance prior to its carriage means engaging the adjacent carriage means to move the second to the lowermost tier from its storage position toward its open, use position, and so on until the engagement of the carriage means associated with the uppermost tier with the adjacent portions of the carriage portions of the support structure precludes further outward expansion of the set of telescoping tiers.

7. The multiple configuration telescopic grandstand of claim wherein the support structure is selectively movable in directions normal to the first and second sides of the vertical portion of said support structure.

8. The multiple configuration telescopic grandstand of claim further comprising means for selectively precluding movement of said support structure without preclusion of movement of said sets of telescoping tiers relative thereto.

9. The multiple configuration telescoping grandstand of claim further comprising means for minimizing movement of the unit in directions normal to the direction of movement of the tiers of said sets between their closed storage position and their open use position.

10. A method for converting the seating configuration of the central open area of an arena or the like comprising the steps of:

a) providing a plurality of multiple configuration telescopic grandstands aligned in substantially side-by-side relation to each other adjacent the periphery of said central area, each of said multiple configuration telescopic grandstands comprising a support structure including a vertical portion having a top edge, a first side and a second side; and, two sets of interconnected, telescoping tiers of grandstand seating connected to said support structure such that one of said sets may be moved selectively between a closed storage position substantially adjacent to said first side of said vertical portion of said support structure and an open position in which the seating tiers extend in stepped relation outwardly and downwardly from said top edge of said vertical portion, and such that the other of said sets may be moved selectively between a closed storage position adjacent the second side of said vertical portion of said support and an open use position in which the seating tiers of said second set extend in stepped relation outwardly from said second side of said vertical portion of said support and downwardly from said top edge of vertical portion of said support, b) opening said first sets of tiers of grandstand seating relative to said support structures;

c) closing said first sets of tiers relative to said support structures;

d) providing pivoting means adapted to receive one of said multiple configuration telescopic grandstand units with said first and second sets of tiers in their closed storage position and to rotate same about a vertical axis;

e) moving one said telescopic grandstand unit with the said first and second sets of tiers in their closed storage position onto said pivoting means;

f) rotating said pivoting means about a vertical axis;

g) moving said multiple configuration grandstand off of said pivoting means and back against the periphery of said central area;

h) opening said second set of telescoping tiers;

i) selectively repeating steps (c) through (h) for each unit of said plurality of units such that the seating configuration of said central area of said arena or the like comprises either no seating, or seating utilizing said first sets of telescoping tiers, or seating utilizing said second set of telescoping tiers.

* * * * *

UNITED STATES PATENT AND TRADEMARK OFFICE

CERTIFICATE OF CORRECTION

PATENT NO. : 5,277,001

DATED : January 11, 1994

INVENTOR(S) : James F. Bryant

It is certified that error appears in the above-indentified patent and that said Letters Patent is hereby corrected as shown below:

In claim 2, at column 10, line 5, between the word "claim" and the word "wherein", add the number -- 1 --;

In claim 6, at column 10, line 45, between the word "claim" and the word "wherein", add the number -- 5 --;

In claim 7, at column 10, line 61, between the word "claim" and the word "wherein", add the number -- 1 --;

In claim 8, at column 10, line 65, between the word "claim" and the word "further", add the number -- 7 --; and In claim 9, at column 11, line 2, between the word "claim" and the word "further", add the number -- 1 --.

Signed and Sealed this

Seventeenth Day of May, 1994

*Attest:*

Bruce Lehman

BRUCE LEHMAN

*Attesting Officer*

*Commissioner of Patents and Trademarks*